US005948365A

United States Patent [19]

Macy et al.

[11] Patent Number: 5,948,365

[45] Date of Patent: Sep. 7, 1999

[54] COLLECTION CONTAINER ASSEMBLY

[75] Inventors: Johnathan I. Macy, Kinnelon, N.J.; Mark Roe, Broken Bow, Nebr.; Karin E. Kelly, Los Angeles, Calif.

[73] Assignee: Becton Dickinson and Company, Franklin Lakes, N.J.

[21] Appl. No.: 08/928,689

[22] Filed: Sep. 12, 1997

[51] Int. Cl.[6] ..... B01L 3/00

[52] U.S. Cl. ..... 422/102; 422/99

[58] Field of Search ..... 422/58, 99, 102, 422/104

[56] References Cited

U.S. PATENT DOCUMENTS

| | | | |
|---|---|---|---|
| 4,483,616 | 11/1984 | Liston et al. | 356/246 |
| 4,578,588 | 3/1986 | Galkin | 250/432 |
| 4,980,129 | 12/1990 | Columbus | 422/61 |
| 5,073,341 | 12/1991 | Hargreaves | 422/58 |
| 5,096,062 | 3/1992 | Burkardt et al. | 206/361 |
| 5,167,929 | 12/1992 | Korf et al. | 422/102 |
| 5,236,604 | 8/1993 | Fiehler | 210/782 |
| 5,288,466 | 2/1994 | Burns | 422/102 |
| 5,384,096 | 1/1995 | Burns | 422/102 |
| 5,454,958 | 10/1995 | Fiehler | 210/782 |
| 5,456,887 | 10/1995 | Calvo et al. | 422/104 |
| 5,458,854 | 10/1995 | Burns | 422/102 |
| 5,527,513 | 6/1996 | Burns | 422/102 |
| 5,536,476 | 7/1996 | Baxter | 422/102 |
| 5,552,117 | 9/1996 | Burns | 422/102 |

OTHER PUBLICATIONS

Cole–Parmer Catalog, p. 1161, 1995/1996.

*Primary Examiner*—Maureen M. Wallenhorst
*Attorney, Agent, or Firm*—Nanette S. Thomas, Esq.

[57] ABSTRACT

The present invention is a collection container assembly including a container having a plurality of fins extending from the bottom of the container wherein the external dimensions of the assembly are substantially the same as a standard-sized blood collection tube but with a reduced internal volume of the container.

6 Claims, 5 Drawing Sheets

COLLECTION CONTAINER ASSEMBLY

BACKGROUND OF THE INVENTION

1. Field of the Invention

This invention relates to a specimen collection container assembly and more particularly to a collection container for collecting biological fluid specimens where a small quantity of fluid may be collected and retained in the container while maintaining a container size sufficient to be easily accommodated and/or compatible with standard clinical equipment and instrumentation.

2. Description of Related Art

Blood samples and other biological fluid specimens are routinely taken and analyzed in hospital and clinical situations for various medical purposes. Collection, handling and testing of these samples typically requires the use of various medical testing instruments. As the blood and fluid specimens are usually collected in a standard sized collection tube, the medical instruments used to test the samples are designed to accommodate these standard sized collection tubes.

Conventional blood collection tubes used in most clinical situations are elongated cylindrical containers having one end closed by a semi-spherical or rounded portion and an opposed open end. The open end may be sealed by a resilient cap or stopper. The tube defines a collection interior which collects and holds the blood sample. The most common size of these blood collection tubes are designed to accommodate approximately 10 ml of blood or other biological fluid samples. Illustrative of such blood collection tubes is the VACUTAINER® brand blood collection tube sold by Becton, Dickinson and Company, 1 Becton Drive, Franklin Lakes, N.J. (registered trademark of Becton, Dickinson and Company).

A phlebotomist or other medical technician typically obtains a specimen of the patient's blood in the tube by techniques well known in the art. The tube is then appropriately labeled and transferred from the site of collection to a laboratory or other location where the contents of the tube are analyzed. During collection and analysis the tube may be supported by various medical instruments. The plasma or serum derived therefrom is processed and analyzed either manually, semi-automatically or automatically. In some cases, the specimen must first be dispensed from the collection tube to a sample test tube or cuvette.

In certain situations it is only necessary to obtain a small quantity of blood or other biological fluid specimens. These situations may include pediatric, or geriatric patients and other instances where large blood samples are not required. Small quantities of blood cannot be easily collected in standard collection tubes as described above because the sample level in such containers would not be adequate for retrieval prior to analysis. Such small quantities of fluids also have a tendency to significantly evaporate when stored in larger containers, thus concentrating the chemical and enzymatic constituents therein. This may result in erroneous analytical results and could possibly affect the diagnosis and treatment given to the patient. Therefore, it is desirable to employ small-volume containers which substantially inhibit evaporation for the storage and delivery of minute fluid samples in the laboratory.

Although various fluid containers are available for this purpose, their small overall size and shape make it difficult for the phlebotomist or other medical technicians to handle and manipulate the tubes. Furthermore, such small dimension tubes are generally incompatible with most handling and testing instrumentation. For example, their use in conventional storage racks or those designed for loading into automatic chemical analyzers is substantially precluded because of their small dimensions. Certain automated chemical analyzers are capable of utilizing standardized conventional specimen containers as a means for introducing a patient's specimen into the analyzer. However, they are generally not equipped to handle specimen containers designed to hold small quantities of fluid. In addition, as the labels placed on most blood collection tubes are read by optical instrumentation such as bar code readers, conventional bar code labels may be too large to be supported on the small volume tubes.

Various specimen containers such as those incorporating a "false bottom" have been proposed to achieve decreased volume capacity in conjunction with standard external dimensions. However, these various specimen containers are not compatible with standard clinical equipment and instrumentation due to their design. In particular, these specimen containers have false bottoms with a generally flat, planar bottom end and a circular shaped opening.

In clinical use, it is desirable for such specimen collection containers to have bottom configurations that closely simulate a standard-sized blood collection tube configuration instead of planar bottoms so as to facilitate compatibility with clinical equipment and instrumentation.

Therefore there is a need to provide a specimen collection container assembly for collecting blood samples and other biological fluid specimens of relatively small volumes where the assembly may be accommodated and/or compatible with standard clinical equipment and/or instrumentation and where the integrity of the sample and specimens are maintained during draw, storage and transport.

SUMMARY OF THE INVENTION

The present invention is a collection assembly comprising a container. The container preferably comprises an open top portion, a bottom portion and a sidewall extending from the open top portion to the bottom portion. The bottom portion comprises a closed bottom end and a plurality of radial fins extending from the closed bottom end.

Most preferably, each fin comprises a top sidewall, an inner sidewall, and an outer sidewall. Most preferably, the top sidewall of each fin is connected to the closed bottom end of the container and extends radially downwardly therefrom and each fin is connected or meets with each other at the inner sidewall of each fin. Therefore, the fins in totality act as an extension to the container so as to make it compatible with clinical equipment and instrumentation.

The fins of the container provide a false bottom effect to the assembly and means for allowing the container to be compatible with standard clinical equipment and instrumentation.

In addition, the assembly may further comprise a closure such as a cap or a stopper at the open end of the container.

Preferably, the external dimensions of the assembly which includes the container and the fins, are about the same as a standard-sized or full draw blood collection container assembly.

Most preferably, the assembly of the present invention can be either evacuated or non-evacuated. Desirably, the assembly is made from polyethylene terephthalate, polypropylene, polyethylene, polyethylene napthalate polyvinyl chloride or copolymers thereof.

An advantage of the assembly of the present invention is that it provides a full-draw blood collection container assembly having a reduced internal volume but with external dimensions about the same as a standard-sized blood collection container assembly.

Standard-sized full draw blood collection containers have an outer diameter of about 13 to about 16 millimeters, a length of about 75 to about 100 millimeters and an internal volume of about 6 to about 10 milliliters.

A further advantage of the assembly of the present invention is that it provides a specimen collection container which is universally compatible with various clinical equipment and instrumentation.

The assembly of the present invention may be easily handled by equipment configured to handle standard-sized blood collection tubes having standard external dimensions.

Most notably, is that the assembly of the present invention provides a blood collection container having full draw external dimensions but with a reduced internal volume as compared to standard-sized full draw blood collection tubes.

The assembly of the present invention therefore addresses the need for a full-draw low-volume blood collection container assembly that presents the external dimensions of a standard-sized blood collection tube.

The assembly of the present invention may be used to reliably collect small samples of blood or biological fluids and to maintain the integrity of the samples during storage and transport as compared to using standard-sized blood collection tubes. In addition, the assembly of the present invention can also be accommodated by standard-sized blood collection, transportation, storage, and diagnostic equipment. Furthermore, the assembly of the present invention may be used to reliably collect small samples of blood or biological fluids without being under partial pressure.

Most notably, is that the assembly of the present invention provides a bottom configuration that substantially simulates a standard-sized blood collection tube with a fully rounded bottom. This particular feature in conjunction with all of the features of the container, distinguishes it from the specimen containers that have a reduced internal volume and a flat planar bottom.

The assembly of the present invention is also compatible with existing instrumentation, labels, and bar code readers and obviates the need for new instrumentation and handling devices or procedures that would be required for smaller or varying sized tubes or tubes with flat planar bottoms.

DETAILED DESCRIPTION

The present invention may be embodied in other specific forms and is not limited to any specific embodiment described in detail which is merely exemplary. Various other modifications will be apparent to and readily made by those skilled in the art without departing from the scope and spirit of the invention. The scope of the invention will be measured by the appended claims and their equivalents.

Figure 1:
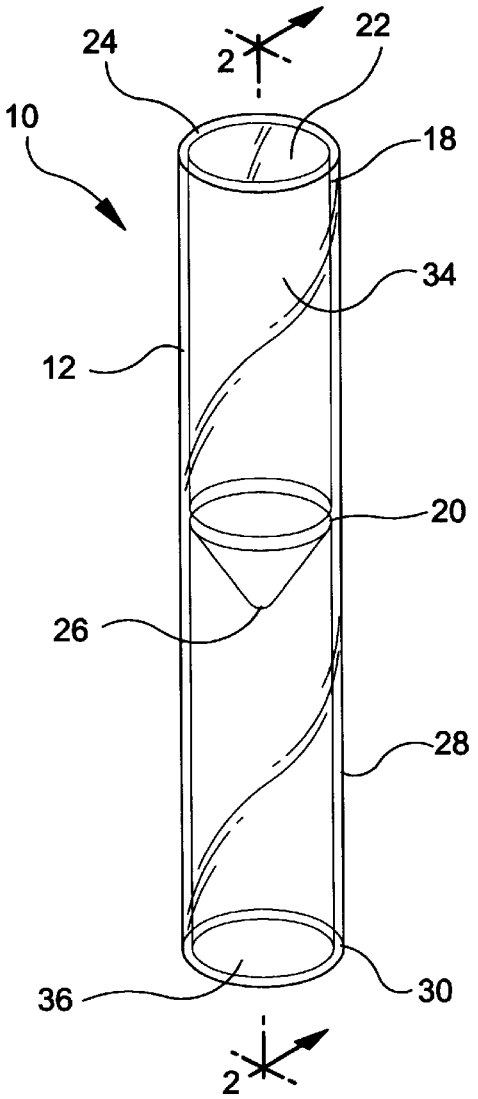
FIG-1 PRIOR ART
FIG. 1 is a perspective view of a false bottom specimen tube of the prior art.
Figure 2:
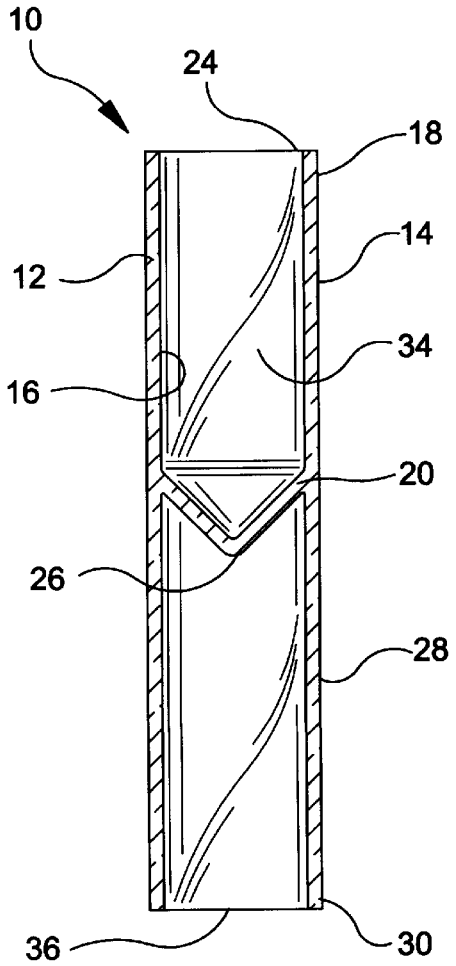
FIG-2 PRIOR ART
FIG. 2 is a longitudinal sectional view of the tube of FIG. 1 taken along line 2—2 thereof.

Referring to the drawings in which like reference characters refer to like parts throughout the several views thereof, FIGS. 1 and 2 show a false bottom specimen container 10 of the prior art, having a sidewall 12 having an outer surface 14 and an inner surface 16. Sidewall 12 extends from an upper portion 18 to a lower portion 20. Upper portion 18 includes an open end 22 and a rim 24. Lower portion 20 comprises a closed bottom end 26. An annular skirt 28 extends from lower portion 20 and outer surface 14 to a flat planar bottom end 30 to define an open false bottom area 36. Interior volume 34 extends between rim 24 and closed bottom end 26.

Figure 3:
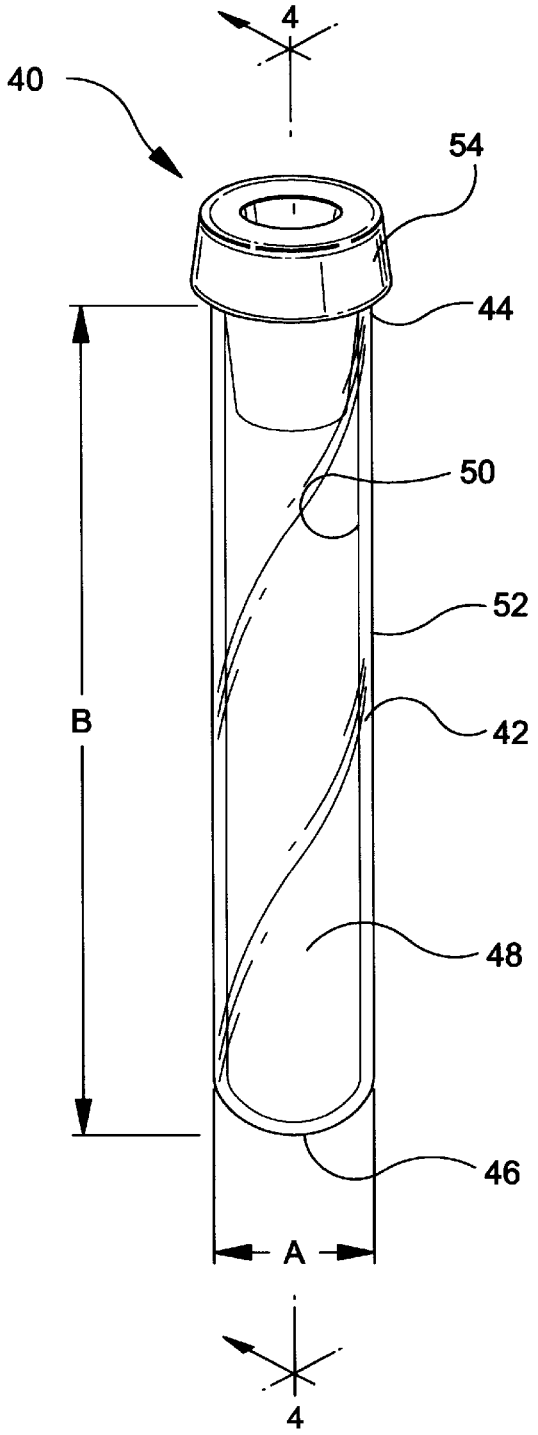
FIG. 3 is a perspective view of a standard sized blood collection tube.
Figure 4:
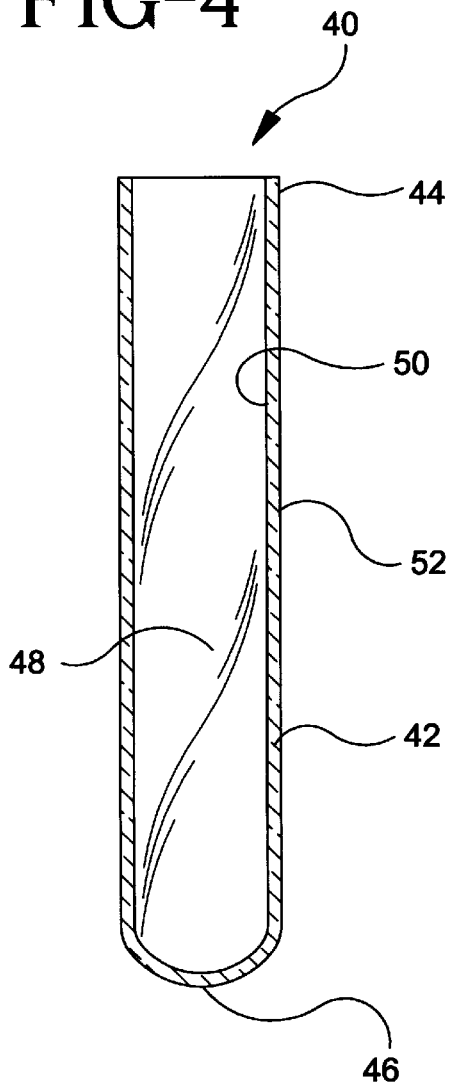
FIG. 4 is a longitudinal sectional view of the tube of FIG. 3 taken along line 4—4 thereof without the stopper.

Referring to the drawings in which like reference characters refer to like parts throughout the several view thereof, FIGS. 3 and 4 show a typical standard sized blood collection tube 40, having a sidewall 42 extending from an open end rim 44 to a closed end 46 and an interior area 48. Sidewall 42 has an inner wall surface 50 and an outer wall surface 52. Optionally, a closure 54 may be on the open end rim 44 of tube 40.

Tube 40 is most preferably a standard-sized blood collection tube having an outer diameter A of about 13 millimeters, a length B of about 75 millimeters and an internal volume 48 of about 6 milliliters as measured from rim 44 to closed end 46.

Interior area 48 is typically maintained at a lower-than-atmospheric internal pressure so that when a blood collection probe penetrates through the closure placing interior area 48 in communication with the circulatory system of a patient, the 48 will draw blood from the patient into the tube. Tube 40 may be described as a full-draw evacuated blood collection tube because the internal pressure of interior area 48 is low enough to draw a volume of blood substantially equal to the volume of interior area 48.

Figure 5:
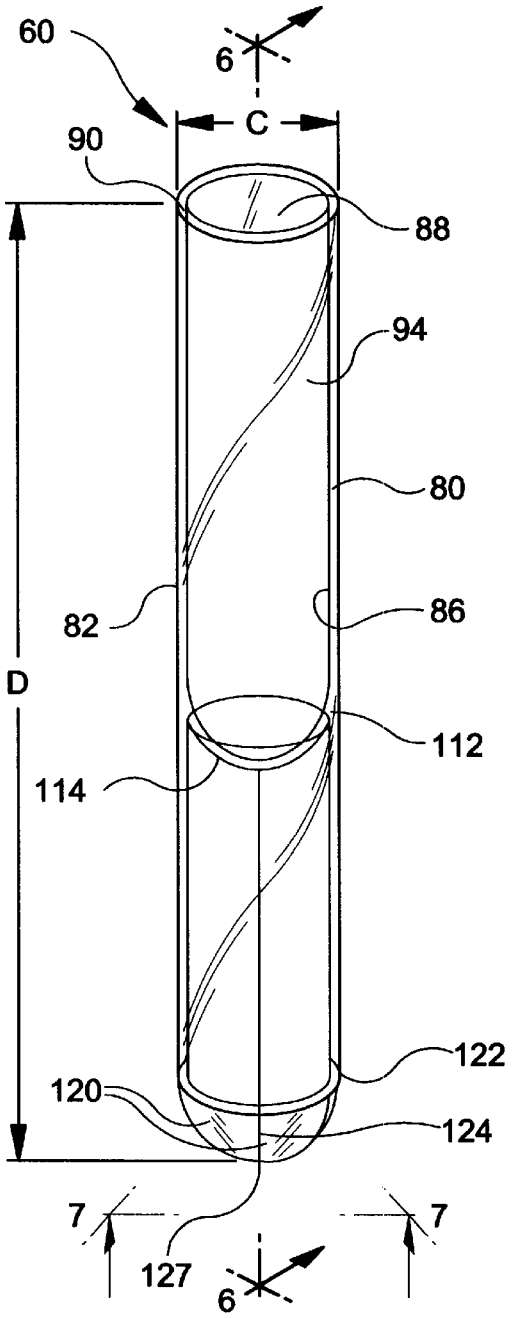
FIG. 5 is a perspective view of the assembly of the present invention.
Figure 6:
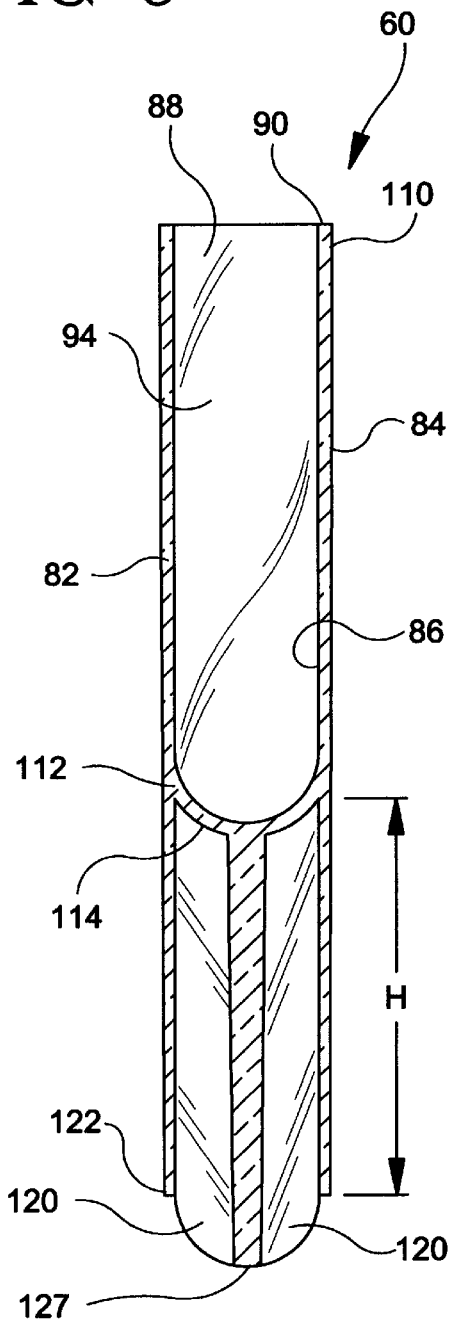
FIG. 6 is a longitudinal sectional view of the assembly of FIG. 5 taken along line 6—6 thereof.

Referring to the drawings in which like reference characters refer to like parts throughout the several views thereof, FIGS. 5 and 6 show the preferred embodiment of the present invention, assembly 60. Assembly 60 comprises a container 80 and fins 120. Container 80 comprises an open end portion 110, a closed end portion 112 having a sidewall 82 having an outer surface 84 and an inner surface 86 and extending from open end portion 110 towards closed end portion 112. Closed end portion 112 has a semi-spherical wall end 114 and open end portion 110 has an open end 88 and a rim 90.

An interior volume 94 extends between rim 90 and closed bottom end 112.

A plurality of fins 120 are located at closed bottom end portion 112 and extend radially from closed bottom end portion 112 and outer surface 84 of sidewall 82. Fins 120 each comprise 3 sidewalls, a top sidewall 122 that is integral with closed bottom end portion 112 and sidewall 82, an inner sidewall 124 and an outer sidewall 126. Top sidewall 122 of each fin extends radially from closed bottom portion 112 of the container. Inner sidewall 124 of each fin meets together at a center point F at the closed bottom end portion of the container. Outer sidewall 126 of each fin has a quarter circle diameter shape so that the fins form an extension to the container whereby the container is compatible with clinical equipment and instrumentation. Outer sidewall 126 and inner sidewall 124 meet at bottom point 127.

Figure 7:
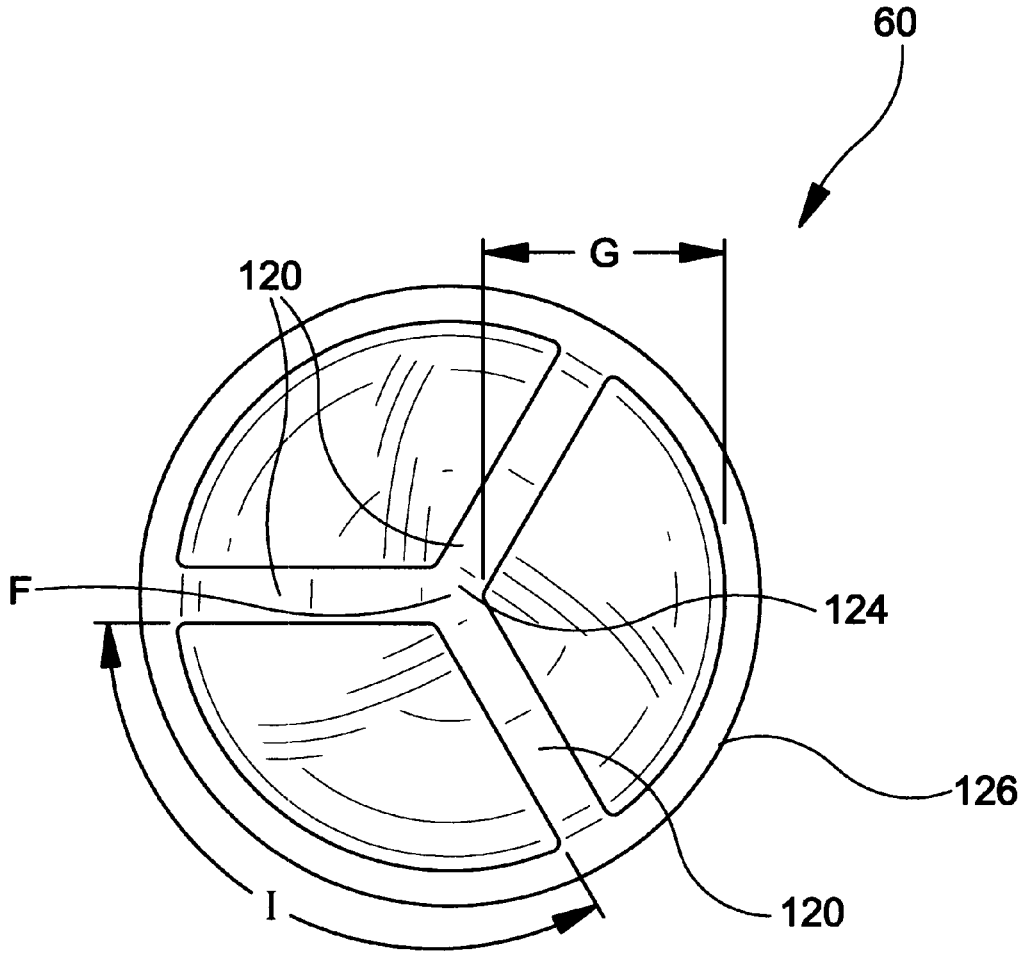
FIG. 7 is a bottom view of the assembly of FIG. 5 taken along line 7—7 thereof.

Most preferably, there are 3 fins extending radially from the assembly so as to act together as an extension to the container so that the container is compatible with clinical equipment and instrumentation. As shown in FIGS. 6 and 7, each fin 120 has a diameter G of about 0.486 inches a length H of about 0.97 inches and a cross-sectional area (or circumference) I of about 0.0394 square inches.

Closed bottom end 112 may be positioned at any point below rim 90 thus providing a variable interior volume 94. Therefore, fins 120 may also be of a varying length and width to accommodate the varying position of the closed bottom end so that the container is always compatible with clinical equipment and instrumentation.

Closed bottom end 112 may be generally semi-spherical in shape, partially rounded or conical in shape. Fins 120 may be integral with sidewall 82 or may be a discrete member. Preferably fins 120 are integrally formed with sidewall 82.

As shown in FIG. 5, assembly 60 has an outer diameter C of about 13 millimeters, a length D of about 75 millimeters, as measured from rim 90 to bottom point 127, and an interior volume 94 of about 1 to 3 milliliters. It is within the purview of this invention that assembly 60 may have an outer diameter of about 13 to about 16 millimeters, a length of about 75 to about 100 millimeters and an interior volume of about 1 to about 3 milliliters.

Fins 120 provides a means for converting the assembly with the extension to substantially the same external dimensions as a standard-sized blood collection tube.

Figure 8:
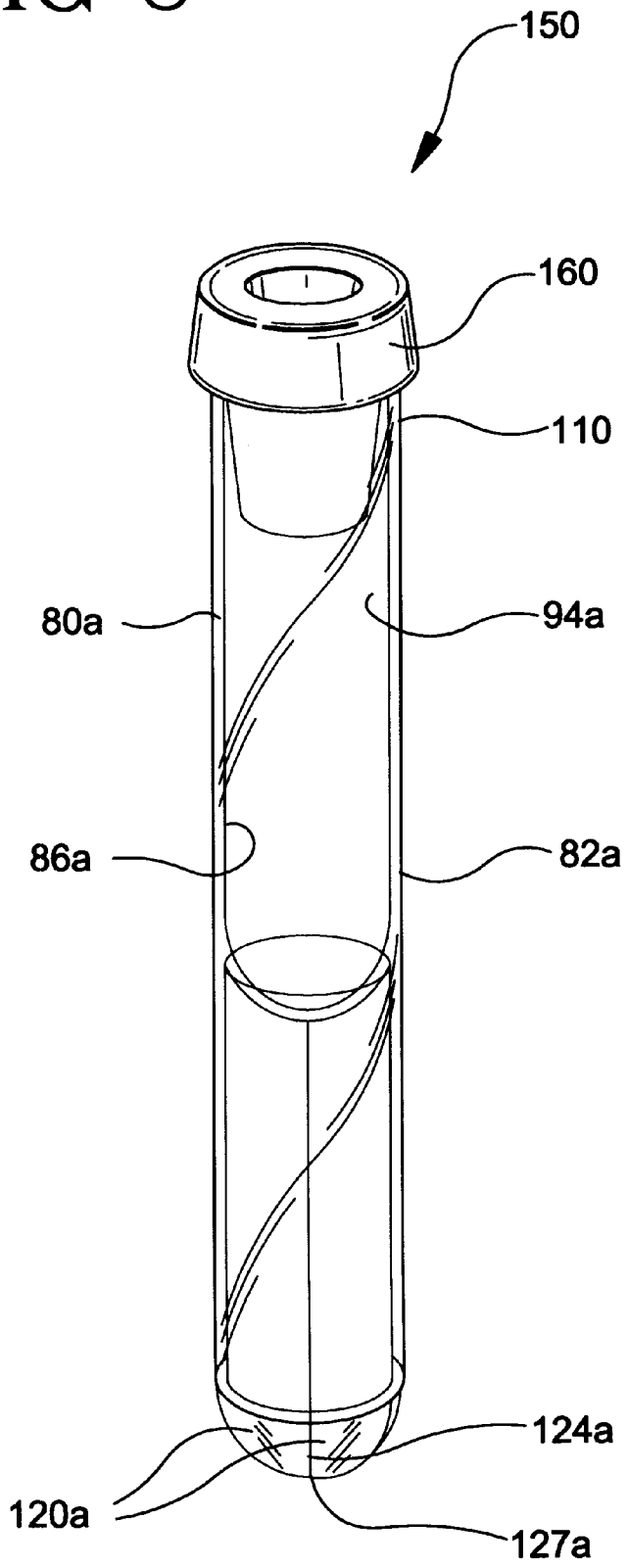
FIG. 8 is a perspective view of an alternate embodiment of the present invention.

The invention, as shown in FIG. 8 includes many components which are substantially identical to the components of FIGS. 5–6. Accordingly, similar components performing similar functions will be numbered identically to those components of FIGS. 5–6, except that a suffix "a" will be used to identify the similar components in FIGS. 8.

As illustrated in FIG. 8, a further embodiment of the invention is assembly 150 which includes a closure 160.

The embodiment of FIG. 8 may be evacuated or non-evacuated. When assembly 150 is evacuated, interior volume 94*a* is typically maintained at a lower-than-atmospheric internal pressure so that when a blood collection probe penetrates through the closure placing interior volume 94*a* in communication with the circulatory system of a patient, the lower-than-atmospheric pressure of interior volume 94*a* will draw blood from the patient into the tube. Assembly 150 may be described as a full-draw evacuated blood collection tube because the internal pressure of interior volume 94*a* is low enough to draw a volume of blood substantially equal to the volume of interior volume 94*a*.

What is claimed is:

1. A collection assembly comprising:

a container comprising a top portion, a closed bottom portion, a sidewall extending from said top portion to said bottom portion; and three fins extending radially downwardly from said bottom portion wherein said fins each comprise a top sidewall integral with the closed bottom portion of the container, an inner sidewall and an outer sidewall, said inner sidewalls are connected to each other at a center point at the closed bottom portion of the container and said outer sidewall of each fin has a quarter circle diameter shape so as to provide a fully rounded bottom to the assembly.

2. The assembly of claim 1, wherein said bottom portion of said container is semi-spherical, rounded or conical.

3. The assembly of claim 1, further comprising a closure.

4. The assembly of claim 1, wherein said container and said fins are made from polyethylene terephthalate, polypropylene, polyethylene, polyethylene napthalate, polyvinyl chloride, or copolymers thereof.

5. The assembly of claim 1, further comprising a diameter, a length and an interior volume, wherein said diameter of said assembly is about 13 to about 16 millimeters, said length of said assembly is about 75 to about 100 millimeters, and said interior volume of said assembly is about 1 to 3 milliliters.

6. The assembly of claim 1, wherein said fins each further comprise a diameter, a length and a cross-sectional area, wherein said diameter of said fins individually is about 0.486 inches, said length of said fins individually is about 0.97 inches, and said cross-sectional area (circumference) of said fins individually is about 0.0394 square inches.

* * * * *